US006361485B1

(12) United States Patent
Robertson

(10) Patent No.: US 6,361,485 B1
(45) Date of Patent: Mar. 26, 2002

(54) METHOD AND APPARATUS FOR CONSTRUCTING AN END PORTION OF A FOOD SAUCE DISPENSING CARTRIDGE

(75) Inventor: Ronald D. Robertson, Kansas City, MO (US)

(73) Assignee: Sealright Co., Inc., Desoto, KS (US)

( * ) Notice: Subject to any disclaimer, the term of this patent is extended or adjusted under 35 U.S.C. 154(b) by 0 days.

(21) Appl. No.: 09/732,471

(22) Filed: Dec. 7, 2000

(51) Int. Cl.[7] ..... B31B 1/44

(52) U.S. Cl. ..... 493/167; 493/156; 229/5.5; 220/620

(58) Field of Search ..... 493/109, 156, 493/158, 159, 162, 167, 174, 185; 229/3.1, 4.5, 5.5, 5.6, 400, 1.5 B; 220/610, 612, 624, 543, 461, 614, 615, 620, 450, 457; 413/26, 27, 43; 29/507

(56) References Cited

U.S. PATENT DOCUMENTS

| | | | | |
|---|---|---|---|---|
| 941,085 | A | | 11/1909 | Marthinson |
| 1,018,319 | A | | 2/1912 | Heyl |
| 1,044,976 | A | | 11/1912 | Beadle |
| 1,285,190 | A | | 11/1918 | Hulbert |
| 1,666,767 | A | | 4/1928 | Annen |
| 1,706,910 | A | | 3/1929 | Wright et al. |
| 2,755,712 | A | | 7/1956 | O'Neil |
| 3,118,351 | A | | 1/1964 | Meyer-Jagenberg |
| 3,990,353 | A | * | 11/1976 | Richards et al. ..... 493/108 |
| 4,117,971 | A | * | 10/1978 | Itoh ..... 229/1.5 B |
| 4,432,473 | A | | 2/1984 | MacEwen |
| 4,556,166 | A | * | 12/1985 | Penttila ..... 229/3.1 |
| 4,830,231 | A | | 5/1989 | Smith |
| 4,836,400 | A | * | 6/1989 | Chaffey et al. ..... 220/81 R |
| 5,476,213 | A | * | 12/1995 | Suski ..... 229/5.5 |
| 5,556,364 | A | * | 9/1996 | Konzal ..... 493/109 |
| 5,624,367 | A | * | 4/1997 | Budziszewski ..... 493/167 |

* cited by examiner

*Primary Examiner*—Peter Vo
*Assistant Examiner*—Remant M. Desai
(74) *Attorney, Agent, or Firm*—Shook, Hardy & Bacon L.L.P.

(57) ABSTRACT

A method and apparatus for constructing a dispensing end portion of a cartridge used to hold and dispense food sauce. A flat end disk is held in a transfer pocket and moved by a disk punch through a die opening smaller in diameter than the disk. The die bends the peripheral portion of the disk into a skirt. The disk punch inserts the disk into the open end of a cartridge body and against a mandrel positioned so that an end portion of the cartridge body extends beyond the skirt. Heat is applied to melt thermoplastic coatings on the disk and cartridge body. A crimping device crimps the end portion oft he cartridge into a flange which is bent against the disk and folds the skirt to form a lip doubled over on the peripheral area of the disk. Thermoplastic coatings bond to weld the flange to the disk with the lip enclosed between them.

14 Claims, 2 Drawing Sheets

METHOD AND APPARATUS FOR CONSTRUCTING AN END PORTION OF A FOOD SAUCE DISPENSING CARTRIDGE

FIELD OF THE INVENTION

This invention relates generally to the construction of food sauce dispensing cartridges and more particularly to a method and apparatus for constructing the dispensing end portion of the cartridge.

BACKGROUND OF THE INVENTION

In fast service restaurants and other food service facilities, various types of food sauces are applied to sandwiches and other foods. Because fast service restaurant chains in particular serve a large volume of customers, it is necessary for the sauces to be dispensed in carefully controlled portions, each of which contains a relatively small amount of sauce that is equal in volume during each dispensing cycle. It has proven to be convenient in applications of this type for the sauces to be packaged in dispensing cartridges from which the sauce is dispensed using handheld dispensing guns. The amount of sauce that is dispensed is controlled by providing suitable valving in the dispensing end of the cartridge and using a dispensing gun that advances a plug in the cartridge a consistent distance each time the trigger of the dispensing gun is squeezed.

Examples of the types of dispensing cartridges that have been used include U.S. Pat. No. 4,432,473 to MacEwen and U.S. Pat. No. 4,830,231 to Smith. While this type of dispensing cartridge has functioned well for the most part, it has been found that the construction of the end disk and its connection with the body of the cartridge can be improved.

In the past, it has been common practice to use "hot melt" adhesive to glue the end disk in place inside the end of the cartridge. Adhesives of this type are normally applied to the inside surface of the disk and cartridge wall where they are in contact with the food sauce that is contained in the cartridge. Consequently, the adhesive must meet food grade standards. Such adhesives are relatively expensive and complicate the manufacturing process because the adhesive must be heated and applied accurately. The adhesive is typically applied in a bead or fillet that must be continuous around the entire periphery of the disk in order to prevent leakage of sauce past the edge of the disk. The raw edge of the disk must be isolated from the food sauce by the adhesive so that the food sauce is prevented from "wicking" into the paperboard edge of the disk. Problems have also been encountered because many of the adhesives that are applied do not exhibit good temperature or chemical resistance properties, thereby limiting the type of products that can be packaged in and dispensed from the cartridge. In the past, the end disk has usually been recessed a significant distance inwardly from the end of the cartridge body. This makes the volume of the cartridge body that is located beyond the disk unavailable to hold the sauce, and the capacity of the cartridge is limited accordingly. When pressure is applied during dispensing of the sauce, the end disk can deflect and thus create problems such as splattering or a variation in the amount of sauce that is dispensed from cycle to cycle.

SUMMARY OF THE INVENTION

Concurrently with the present invention, an improved end construction has been developed for dispensing cartridges that hold food sauces and other foods. In the improved end construction, the end disk of the cartridge has a peripheral skirt that is folded back on itself when a flange on the end portion of the cartridge body is crimped against the outer surface of the end disk and heat sealed in place. The raw edge of the disk is isolated from the food sauce because it is enclosed between the flange and disk. Also, a stronger end construction is provided due to the double thickness that results from the folded over skirt and also the additional layer that results from crimping of the flange along the peripheral portion of the disk. Other advantages are achieved as well.

The present invention is directed to a method and apparatus for effectively and reliably producing an end construction of this type in an economical manner. More particularly, it is an object of the invention to provide a method and apparatus that involves forming a peripheral skirt on an end disk, inserting the disk into an open end of a cartridge body to a selected location, crimping the end portion of the cartridge body to form a flange which folds the skirt on the disk in order to provide a double over lip on the peripheral area of the disk, and heat sealing the flange such that the lip and its raw edge are enclosed and sealed between the flange and disk. This method of forming the end avoids the expense of "hot melt" adhesives which have been used in the past to glue the end disk in place in this type of food container.

In accordance with the invention, the disk may be initially provided in a planar form and held in a transfer pocket. A disk punch is activated to move the disk from the transfer pocket through a die opening that is smaller in diameter than the disk. As a result, the periphery of the disk is folded or bent at a right angle to form a peripheral skirt on the disk. The die may have two portions which successively decrease in diameter to facilitate the formation of the skirt.

The disk punch continues its operation to insert the disk into the open dispensing end of the cartridge body and against a mandrel that provides a stop for properly locating the disk in the cartridge. With the mandrel holding the disk in place, a crimping device deforms the end portion of the cartridge body inwardly to form a flange which is folded against the disk. As the flange is bent inwardly from the cartridge body, it folds the skirt against the disk to provide a doubled over lip on the peripheral area of the disk.

Immediately prior to the crimping operation, heat may be applied to melt thermoplastic coatings on the cartridge body and disk. When the parts are crimped together, the thermoplastic creates a bond between them and results in the plastic creating a weld and sealing the disk periphery to the sidewall of the cartridge. The lip and its raw paperboard edge are thus enclosed and sealed between the flange and disk so that the paperboard edge is isolated from the food sauce held in the cartridge.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

The present invention provides a method and apparatus for constructing the dispensing end portion of a cartridge of the type that is used to hold and dispense food sauces and other foods. This type of dispensing cartridge is generally described in U.S. Pat. No. 4,432,473 to MacEwen, as is a handheld dispensing gun which is used with the cartridge in order to dispense the food sauce. The aforementioned MacEwen patent is incorporated herein by reference as to the general construction of a food sauce dispensing cartridge of the type to which the present invention relates.

Figure 1:
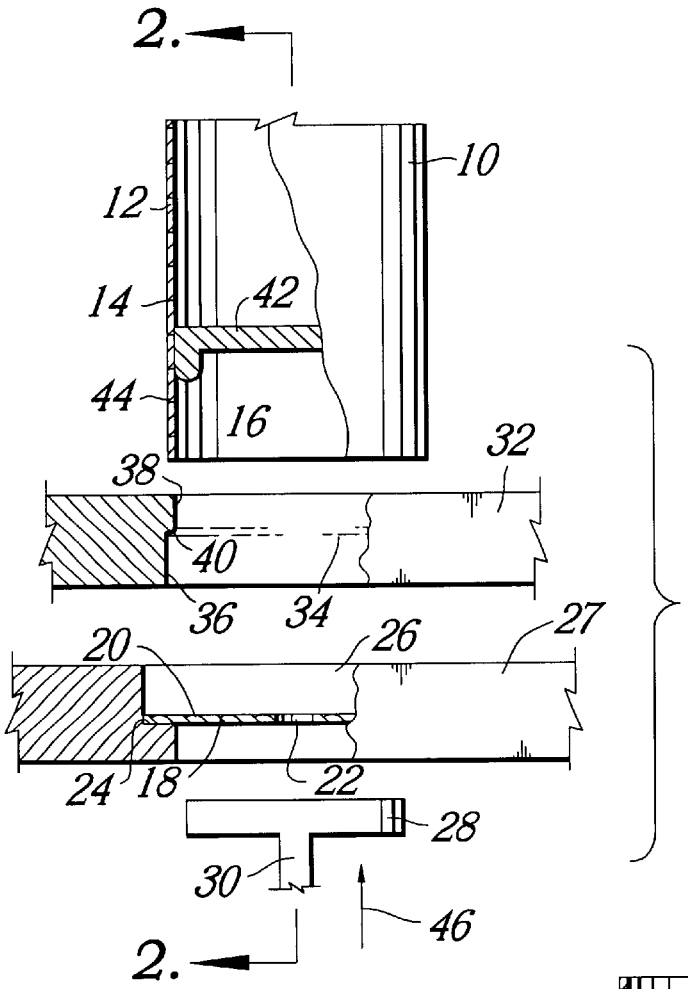
FIG. 1 is a diagrammatic side elevational view of an apparatus that is constructed according to a preferred embodiment of the present invention and used to carry out a method for constructing an end portion of the food sauce dispensing cartridge, with portions broken away for purposes of illustration.

Referring now to the drawings in more detail and initially to FIG. 1, numeral 10 designates a cartridge body which forms a container having a hollow interior for holding food sauce and other foods. The cartridge body 10 has a cylindrical sidewall 12 which is preferably a foil laminated food grade paperboard rolled into the shape of a cylinder. The sidewall 12 has an overlapping area which forms a seam (not shown) which is suitably secured to provide the cartridge with a leakproof construction. Both the inside and outside surfaces of the sidewall 12 are preferably coated with thermoplastic, preferably polyethylene. The thermoplastic coating on the inside surface of the sidewall 12 is indicated by numeral 14 in FIG. 1. The container body 10 has an end 16 that is initially open and is located at the dispensing end of the cartridge. The opposite end of the cartridge body 10 is provided with a plug (not shown) that may be advanced into the cartridge body for dispensing of the contents, as disclosed in U.S. Pat. No. 4,432,473.

In accordance with the present invention, an end disk 18 is applied to the dispensing end 16 of the cartridge body 10. The disk 18 may initially be in the form of a planar panel having a circular edge and a thermoplastic coating on both of its flat surfaces. The coating is preferably polyethylene, identified by numeral 20 on the upwardly facing surface of disk 18 in FIG. 1. The disk 18 is provided with one or more valve openings 22 through which the food sauce held in the container body 10 is dispensed. The disk 18 has a diameter that is greater than the inside diameter of the cartridge wall 12.

Disk 18 is initially positioned on an annular ledge 24 which faces upwardly within a transfer pocket 26 formed in a die 27. The disk 18 is preferably oriented in a horizontal plane on the ledge 24.

A circular disk punch 28 carried on an arm 30 is initially located below the pocket 26 and the disk 18. Located above the die 28 is a die block 32 which is provided with an opening 34. The opening 34 has a lower portion 36 which is smaller in diameter than the disk 18. Immediately above the opening portion 36, opening 44 has another opening portion 38 which is smaller in diameter than opening portion 36 and substantially equal to or slightly lesser in diameter than the inside diameter of the cartridge sidewall 12. The diameter of the head of punch 28 is less than the diameter of opening partition 38 by approximately twice the thickness of the disk 18. A radius shoulder 40 separates the two opening portions 36 and 38.

The container body 10 is held above the die block 32 with a mandrel 42 positioned closely inside of the cartridge body 10 and spaced above the open end 16. An end portion 44 of the cartridge body 10 extends downwardly beyond the mandrel 42.

Figure 2:
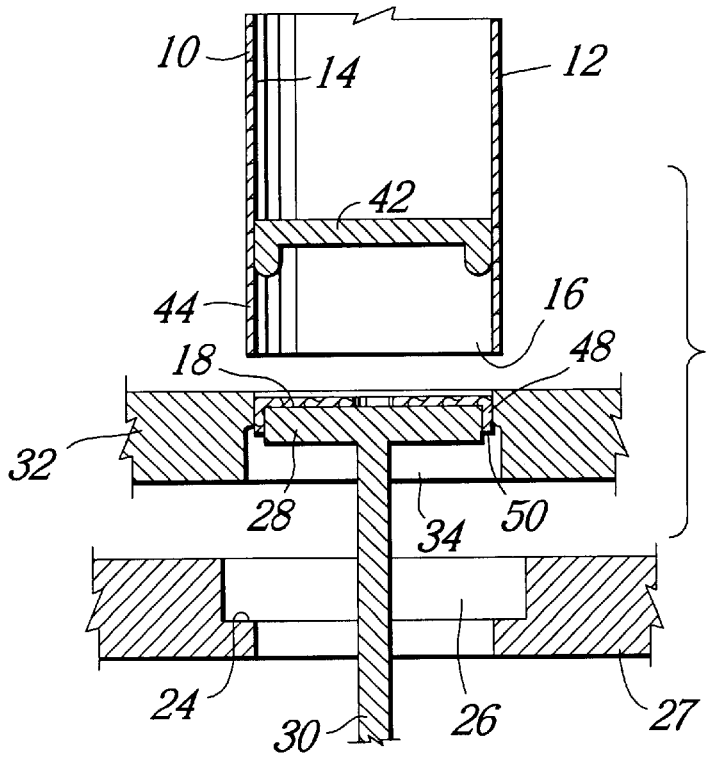
FIG. 2 is a sectional view taken generally along line 2—2 of FIG. 1 in the direction of the arrows and diagrammatically showing the disk moved by a disk punch through a die opening in order to form a peripheral skirt on the disk according to a preferred embodiment of the present invention.

In order to apply the disk 18 to the dispensing end 16 of the cartridge body and complete the end construction of the cartridge, the disk punch 28 is initially raised, as indicated by the directional arrow 46 in FIG. 1. The disk punch 28 is moved through the transfer pocket 26 and thereby lifts the disk 18 off of ledge 24 and moves it toward the overlying die block 32. As the disk 18 is raised by punch 28 into the lower portion 36 of opening 34, the peripheral portion of the disk 18 is bent or folded downwardly due to the greater diameter of disk 18 compared to opening portion 36. As the disk continues to be raised by punch 28 into opening portion 38, the peripheral portion of the disk is deformed into the form of a projecting skirt 48 which is shown in FIG. 2. The skirt 48 is bent or folded at a right angle to the flat main portion of the end disk 18. The skirt 48 terminates in an edge 50 which is normally at least partly a raw paperboard edge.

Due to the diameter of punch 28 being smaller than the diameter of opening portion 38 by twice the thickness of disk 18, the skirt 48 is neatly bent about the periphery of punch 28 between the edge of the punch and the wall of opening portion 38. Bending of the skirt in both opening portions 36 and 38 successively reduces the stress and enhances the bending of the skirt.

Figure 3:
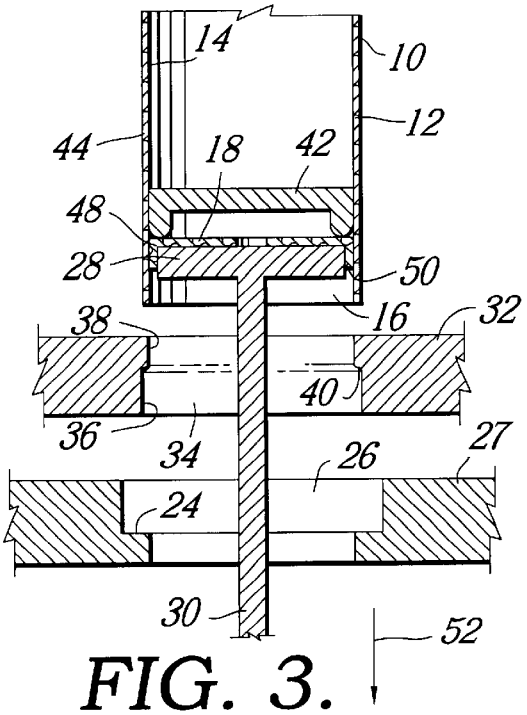
FIG. 3 is a sectional view similar to FIG. 2, but diagrammatically showing the disk punch advance in order to insert the disk into the end portion of a cartridge body and against a stationary mandrel.

Referring now to FIG. 3, the disk punch 28 continues to move upwardly and raises the disk 18 out of opening 34 and thereafter inserts the disk into the open end 16 of cartridge body 10. The disk punch 28 moves the disk 18 into the cartridge body until the disk contacts the mandrel 42 which serves as a stop for accurately positioning the disk relative to the end 16 of the cartridge body. The skirt 48 is adjacent to the inside surface of the cartridge wall 12. The position of the mandrel 42 is such that the end portion 44 of the cartridge body extends well beyond the edge 50 of skirt 48.

Figure 4:
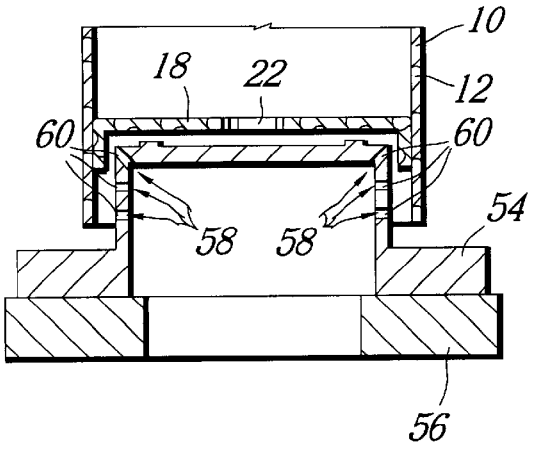
FIG. 4 is a fragmentary sectional view of the end portion of the cartridge showing the manner in which heat may be applied in accordance with the invention.

The end disk 18 may be held in place against the mandrel 42 in any suitable manner so that the disk punch 28 can be withdrawn from the cartridge body 10, as indicated by the directional arrow 52 in FIG. 3. As shown diagrammatically in FIG. 4, a heating device includes a hollow heating block 54 carried on a base 56. The block 54 receives heated air which is indicated by the arrows 58 and which is passed into the interior of block 54 and through passages 60 against the adjacent bonding surfaces of the disk periphery, the skirt 48, and the extending end portion 44 of the cartridge body 10. The heated air melts the thermoplastic coatings 14 and 20 on the cartridge wall and disk.

Figure 5:
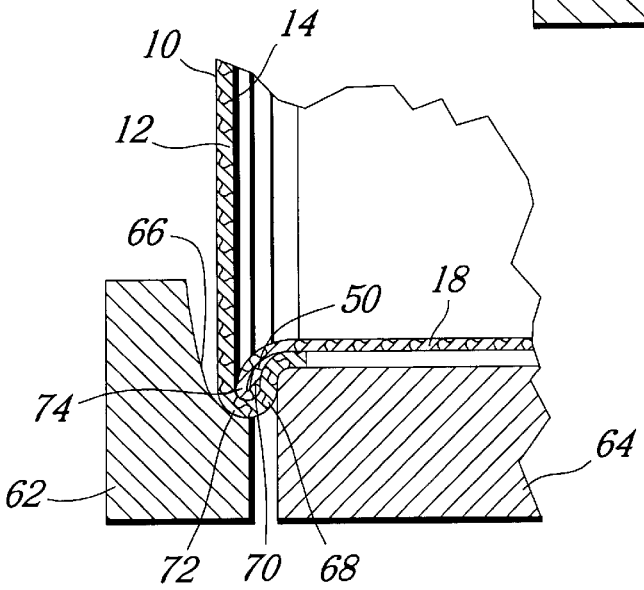
FIG. 5 is a fragmentary sectional view on an enlarged scale showing tooling that may be used to crimp the end portion of the cartridge in accordance with the invention.
Figure 6:
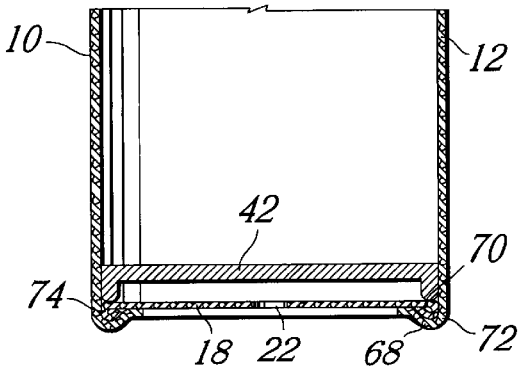
FIG. 6 is a sectional view of the end portion of the cartridge body after it has been crimped against the end disk.

Immediately thereafter, the cartridge is separated from the heating block 54. As shown in FIG. 5, a pair of crimping dies 62 and 654 are then used to apply crimping forces on the cartridge end portion 44. Die 62 has a curved surface 66 which is brought against the end portion 44 to fold it inwardly to form an in turned flange 68. The other crimping die 64 presses the flange 68 against the peripheral area of the disk 18. As the flange 68 is formed and folded against disk 18, the crimping operation folds the skirt 48 against the peripheral area of the disk to form the skirt into a lip 70 which is doubled over on the peripheral portion of the end disk. The edge portion of the flange 68 extends inwardly beyond the skirt edge 50 so that the entirety of the skirt 48, including edge 50, is sandwiched between the flange 58 on one side and the disk 18 on the other side.

When the components are pressed together during the crimping operation, the melted thermoplastic bonds them together and creates a sturdy weld that seals the disk periphery to the side wall of the cartridge. The thermoplastic provides a heat seal and bond between a shoulder 72 which is formed where the flange 68 is bent from the cartridge body and a fold 74 formed where the lip 70 is doubled over from the periphery of the disk 18. This heat seal and bond encloses the lip 70 and the raw edge 50 in the area between the disk 18 and flange 68, with the seal and bond between the fold 74 and the cartridge side wall also assisting in isolating the lip and particularly the edge 50 from the food sauce that is subsequently contained in the cartridge body 10.

While the method of the present invention is preferably carried out using the apparatus which is disclosed, it is to be understood that other types of equipment can be used to construct the end portion of the dispensing cartridge. It should also be understood that the method of the present invention can be used to construct end portions of other types of food containers, including lids that form covers for food packaging of various types.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A method of connecting an end disk to a cartridge body for a dispenser cartridge used to hold and dispense food sauce, comprising the steps of:

forming a peripheral skirt on said end disk;

inserting said end disk into said cartridge body with said skirt adjacent to said body;

crimping an end portion of said cartridge body to form a flange extending on said disk and simultaneously folding said skirt to form a lip which is doubled over on the disk; and sealing said flange against said disk with said lip enclosed between said flange and disk.

2. A method as set forth in claim 1, wherein said step of sealing said flange against said disk comprises effecting a heat seal therebetween.

3. A method as set forth in claim 2, wherein:

said disk and cartridge body have thermoplastic coatings thereon; and said step of sealing said flange against said disk comprises applying heat to said flange and disk prior to said crimping step to melt said coatings and bond said flange to said disk when said crimping step is effected.

4. A method as set forth in claim 1, wherein said step of forming a peripheral skirt on said end disk comprises deforming a peripheral portion of said disk into said skirt.

5. A method as set forth in claim 4, wherein said step of deforming a peripheral portion of said disk comprises forcing said disk through a die opening smaller in diameter than said disk to bend the peripheral portion of the disk to form said skirt.

6. A method as set forth in claim 4, wherein:

said disk and cartridge body have thermoplastic coatings thereon; and said step of sealing said flange comprises applying heat to said flange and disk to melt said coatings and heat seal the flange to the disk.

7. A method of constructing an end of a container used to hold and dispense food sauce, comprising the steps of:

providing a substantially cylindrical container body having an open end;

providing a generally planar end disk having a peripheral skirt extending at substantially a right angle from the periphery of the disk, said skirt terminating in an edge;

inserting said end disk into said open end of the container body with said skirt adjacent to the container body and an end portion of the container body extending beyond said disk and skirt;

crimping said end portion against said disk to form said end portion into a flange and to fold said skirt into a lip doubled over on said disk; and sealing said flange to said lip and disk with said lip and edge enclosed between said flange and disk.

8. A method as set forth in claim 7, including the step of deforming a peripheral portion of said end disk to form said skirt thereon.

9. A method as set forth in claim 8, wherein said step of deforming a peripheral portion of said disk comprises forcing said disk through a die opening smaller in diameter than said disk to bend the peripheral portion of the disk to form said skirt.

10. A method as set forth in claim 7, wherein:

said disk and container body have thermoplastic coatings thereon; and said step of sealing said flange to said lip and disk comprises applying heat to said flange and disk prior to said crimping step to melt said coatings and heat seal said flange to said lip and disk when said crimping step is effected.

11. A method of assembling an end disk and a food container body both having thermoplastic coatings, comprising the steps of:

bending said end disk at a peripheral portion thereof to form a peripheral skirt on the disk;

inserting said disk into the container body such that an end portion of the container body extends beyond said skirt;

applying heat to said end portion and disk to melt said coatings; and deforming said end portion of the container body inwardly to form a flange extending along the disk, said deformation folding said skirt to form a lip which is doubled over on the disk, with said coatings effecting a heat seal of said flange to said disk an d enclosing said lip between said flange and disk.

12. A method as set forth in claim 11, wherein said step of bending said end disk comprises forcing said disk through a die opening smaller in diameter than the disk to bend the peripheral portion of the disk into said skirt.

13. Apparatus for use in connecting a substantially planar end disk in a generally cylindrical container body used to hold and dispense food sauce, said apparatus comprising:

a pocket for receiving and holding said disk;

a die having a generally circular die opening smaller in diameter than said disk and substantially equal in diameter to the inside of said container body;

a disk punch operable to move said disk from said pocket through said die opening to deform a peripheral portion of the disk into the form of a peripheral skirt extending from the disk at approximately 90° and terminating in an edge;

a mandrel fitting in said container body at a preselected location therein, said punch being operable to insert said disk into the container body against said mandrel;

a crimping mechanism operable to crimp an end portion of said container body inwardly into the form of a flange and to simultaneously fold said skirt into a lip which is doubled over on the disk with said lip and edge sandwiched between said flange and disk; and a heat sealing device operable to effect a heat seal of said flange to said disk to enclose said lip and edge.

14. Apparatus as set forth in claim 13, wherein said die opening includes first and second portions through which said disk is successively forced by said disk punch, said second portion being smaller in diameter than said first portion.

* * * * *